US008928573B2

(12) United States Patent
Cao

(10) Patent No.: US 8,928,573 B2
(45) Date of Patent: Jan. 6, 2015

(54) SHIFT REGISTER, GATE DRIVER ON ARRAY PANEL AND GATE DRIVING METHOD

(71) Applicant: Beijing Boe Optoelectronics Technology Co., Ltd., Beijing (CN)

(72) Inventor: Kun Cao, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 76 days.

(21) Appl. No.: 13/806,177

(22) PCT Filed: Nov. 20, 2012

(86) PCT No.: PCT/CN2012/084918

§ 371 (c)(1),
(2) Date: Dec. 21, 2012

(87) PCT Pub. No.: WO2013/097559

PCT Pub. Date: Jul. 4, 2013

(65) Prior Publication Data

US 2014/0062846 A1 Mar. 6, 2014

(30) Foreign Application Priority Data

Dec. 30, 2011 (CN) ..... 2011 1 0457609

(51) Int. Cl.
*G09G 3/36* (2006.01)

(52) U.S. Cl.
CPC ..... *G09G 3/3648* (2013.01); *G09G 3/36* (2013.01)
USPC ..... 345/100; 345/87; 345/98

(58) Field of Classification Search
USPC ..... 345/87–104, 204–215, 690–699
See application file for complete search history.

(56) References Cited

U.S. PATENT DOCUMENTS

| | | | | |
|---|---|---|---|---|
| 8,054,279 | B2 * | 11/2011 | Umezaki et al. | 345/100 |
| 8,508,459 | B2 * | 8/2013 | Miyake | 345/100 |
| 8,718,224 | B2 * | 5/2014 | Toyotaka | 377/64 |
| 2007/0195920 | A1 | 8/2007 | Tobita | |
| 2008/0079685 | A1 * | 4/2008 | Umezaki et al. | 345/100 |
| 2008/0165110 | A1 * | 7/2008 | Kim et al. | 345/99 |

(Continued)

FOREIGN PATENT DOCUMENTS

| | | | |
|---|---|---|---|
| CN | 101206318 | A | 6/2008 |
| CN | 101295546 | A | 10/2008 |

(Continued)

OTHER PUBLICATIONS

International Search Report mailed Mar. 7, 2013; PCT/CN2012/084918.

(Continued)

*Primary Examiner* — Dmitriy Bolotin
(74) *Attorney, Agent, or Firm* — Ladas & Parry LLP

(57) ABSTRACT

The embodiment of the present invention discloses a shift register for reducing the power consumption during driving. The shift register includes a protection circuit, a retaining circuit, an output circuit, a first driving circuit, a second driving circuit, a resetting circuit, a timing control terminal, a first power supply terminal, a second power supply terminal, a third power supply terminal and a fourth power supply terminal. The embodiment of the present invention further discloses a Gate driver On Array (GOA) panel and a method for gate driving.

20 Claims, 3 Drawing Sheets

(56) References Cited

U.S. PATENT DOCUMENTS

| | | | | |
|---|---|---|---|---|
| 2012/0032937 | A1* | 2/2012 | Koo | 345/211 |
| 2012/0056860 | A1* | 3/2012 | Umezaki et al. | 345/205 |
| 2013/0307604 | A1* | 11/2013 | Miyake | 327/291 |
| 2013/0322592 | A1* | 12/2013 | Miyake et al. | 377/64 |
| 2014/0055440 | A1* | 2/2014 | Cho et al. | 345/212 |

FOREIGN PATENT DOCUMENTS

| | | | |
|---|---|---|---|
| CN | 101388197 | A | 3/2009 |
| CN | 101650909 | A | 2/2010 |
| CN | 101727800 | A | 6/2010 |
| CN | 102646401 | A | 8/2012 |
| JP | 2008-140522 | A | 6/2008 |
| WO | 2009/034750 | A1 | 3/2009 |

OTHER PUBLICATIONS

First Chinese Office Action issuing date: Apr. 3, 2013; Appln. No. 201110457609.8.

Chinese Patent Office Notification to Grant Patent Right; issued Aug. 23, 2013; Appln. No. 201110457609.8.

International Preliminary Report on Patentability dated Jul. 1, 2014; PCT/CN2012/084918.

* cited by examiner

SHIFT REGISTER, GATE DRIVER ON ARRAY PANEL AND GATE DRIVING METHOD

TECHNICAL FIELD

The present disclosure relates to field of electronics and liquid crystal display.

BACKGROUND

A technique of amorphous silicon thin film transistors Gate driver On Array (GOA) has been increasingly applied to the field of Thin Film Transistor-Liquid Crystal Display (TFT-LCD) manufacturing process. However, there exists a relatively large distortion in the output waveform of the current GOA driving unit, which may result in poor performance of the driving effect. Moreover, as the switching characteristic of the amorphous silicon Thin Film Transistor is inferior to that of the monocrystalline silicon Metal-Oxide-Semiconductor Transistor, the power consumption of the former during the driving is relatively larger than that of the latter.

In order to effectively drive the gate and reduce a whole power consumption of the amorphous silicon thin film transistors GOA, the design in the structure of a new GOA driving unit and an operating mode of a series of the GOA driving unit are t important issues in the technique of amorphous silicon thin film transistors GOA.

SUMMARY

The embodiments of the invention provide a shift register, GOA TFT-LCD panel (simply called as GOA panel), for reducing the power consumption in the gate driver.

The shift register includes: a protection circuit for ensuring an output signal of an output circuit to be at a first level signal, a retaining circuit for controlling the protection circuit, the output circuit for outputting a signal, a first driving circuit for driving the output circuit, a second driving circuit for driving the retaining circuit, a resetting circuit for resetting the shift register, a timing control terminal for supplying a first number of timing control signals to a GOA TFT-LCD panel, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit;

wherein the timing control terminal is connected to an input terminal of the output circuit;

a control terminal of the first driving circuit is connected to a first external signal terminal, and an input terminal of which is connected to the fourth power supply terminal;

a control terminal of the second driving circuit is connected to a first external signal terminal, an input terminal of which is connected to the fourth power supply terminal, and an output terminal of which is connected to the protection circuit;

a first input terminal of the retaining circuit is connected to the third power supply terminal, a second input terminal of which is connected to the second power supply terminal, and an output terminal of which is connected to the protection circuit;

a first input terminal of the protection circuit is connected to the second power supply terminal and the second input terminal of the retaining circuit, and a second input terminal of the protection circuit is connected to the first power supply terminal;

a control terminal of the output circuit is connected to an output terminal of the first driving circuit, a first output terminal of the protection circuit, a first control terminal of the protection circuit, an output terminal of the resetting circuit and a control terminal of the retaining circuit, respectively, and an output terminal of the output circuit is connected to a second control terminal of the protection circuit; and an input terminal of the resetting circuit is connected to the first power supply terminal, and a control terminal of which is connected to a second external signal terminal.

A GOA TFT-LCD panel comprises at least one of the shift registers.

A gate driving method, applied for the GOA TFT-LCD panel comprises the steps of:

outputting a first level signal from a first external signal terminal to make the first driving circuit and the output circuit turn off, and make a protection circuit output a first level signal;

outputting a second level signal from the first external signal terminal to make the first driving circuit and the output circuit turn on and make a timing control terminal output the first level signal so as to allow the output circuit to output the first level signal;

inputting the second level signal from the first external signal terminal to make the first driving circuit turn off, the output circuit turn on, the timing control terminal output the second level signal, and make the output circuit output the second level signal;

inputting the first level signal from the first external signal terminal to turn off the first driving circuit, and inputting the second level signal from the second external signal terminal to turn on the resetting circuit; and outputting the first level signal from the resetting circuit to make the output circuit turn off, and make the protection circuit output the first level signal.

The shift register in the embodiment of the present invention includes: a protection circuit for ensuring an output signal of an output circuit to be at a first level signal, a retaining circuit for controlling the protection circuit, the output circuit for outputting a signal, a first driving circuit for driving the output circuit, a second driving circuit for driving the retaining circuit, a resetting circuit for resetting the shift register, a timing control terminal for supply a first number of timing control signals to the GOA TFT-LCD panel, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit; wherein the timing control terminal is connected to an input terminal of the output circuit; a control terminal of the first driving circuit is connected to a first external signal terminal, and an input terminal of which is connected to the fourth power supply terminal; a control terminal of the second driving circuit is connected to a first external signal terminal, an input terminal of which is connected to the fourth power supply terminal, and an output terminal of which is connected to the protection circuit; a first input terminal of the retaining circuit is connected to the third power supply terminal, a second input terminal of which is connected to the second power supply terminal, and an output terminal of which is connected to the protection circuit; a first input terminal of the protection circuit is connected to the second power supply terminal and the second input terminal of the retaining circuit, and a second input terminal of the protection circuit is connected to the first power supply terminal; a control terminal of the output circuit is connected to an output terminal of the first driving circuit, a first output terminal of the protection circuit, a first control terminal of the protection circuit, an output terminal of the resetting circuit and a control terminal of the retaining circuit respectively, and an output terminal of the output circuit is connected to a second control terminal of the protection circuit; an input terminal of the resetting circuit is connected to the first power supply terminal, and a control terminal of which is connected to a second external signal terminal. It can avoid potential interference and perform the effective driving with the protection circuit and the retaining circuit controlling the output circuit to output an appropriate signal; in the meantime, since multiple timing control signals are employed in the GOA TFT-LCD panel (referred to as GOA panel for short), it can effectively reduce the power consumption. Additionally, the resetting circuit can perform the resetting in time after completion of the operating state so as to await the next operating state, thus avoiding the malfunction.

DETAILED DESCRIPTION

Figure 1:
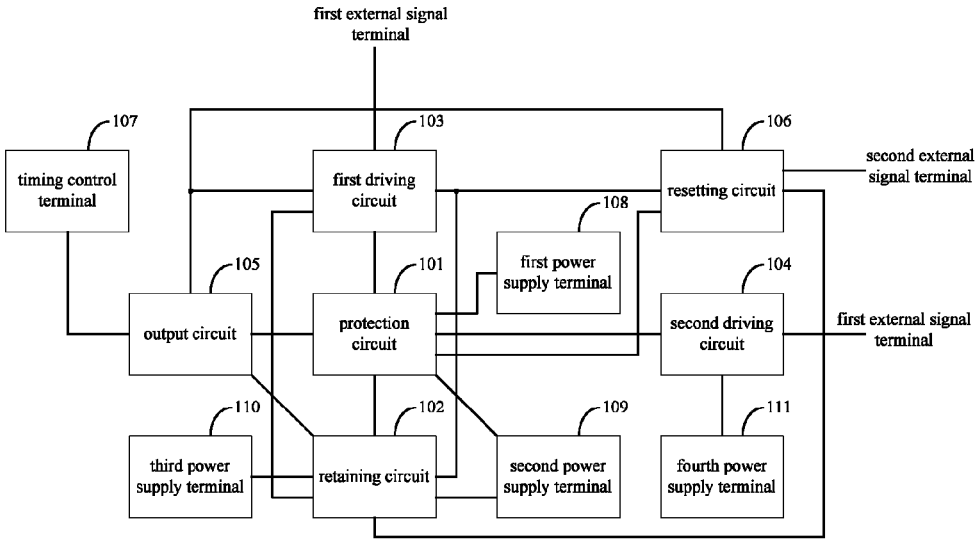
FIG. 1 is a diagram showing a main structure of a shift register in an embodiment of the present invention.

The shift register in an embodiment of the present invention includes: a protection circuit for ensuring an output signal of an output circuit to be at a first level signal, a retaining circuit for controlling the protection circuit, the output circuit for outputting a signal, a first driving circuit for driving the output circuit, a second driving circuit for driving the retaining circuit, a resetting circuit for resetting the shift register, a timing control terminal for providing the GOA panel with a first number of timing control signals, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit; wherein the timing control terminal is connected to an input terminal of the output circuit; a control terminal of the first driving circuit is connected to a first external signal terminal, and an input terminal of the first driving circuit is connected to the fourth power supply terminal; a control terminal of the second driving circuit is connected to a first external signal terminal, an input terminal of the second driving circuit is connected to the fourth power supply terminal, and an output terminal of the second driving circuit is connected to the protection circuit; a first input terminal of the retaining circuit is connected to the third power supply terminal, a second input terminal of the retaining circuit is connected to the second power supply terminal, and an output terminal of which is connected to the protection circuit; a first input terminal of the protection circuit is connected to the second power supply terminal and the second input terminal of the retaining circuit, and a second input terminal of the protection circuit is connected to the first power supply terminal; a control terminal of the output circuit is connected to an output terminal of the first driving circuit, a first output terminal of the protection circuit, a first control terminal of the protection circuit, an output terminal of the resetting circuit and a control terminal of the retaining circuit respectively, and an output terminal of the output circuit is connected to a second control terminal of the protection circuit; an input terminal of the resetting circuit is connected to the first power supply terminal, and a control terminal of which is connected to a second external signal terminal. It can avoid potential interference and perform the effective driving with the protection circuit and the retaining circuit controlling the output circuit to output an appropriate signal; in the meantime, since multiple timing control signals are employed in the GOA panel, it can effectively reduce the power consumption. Additionally, the resetting circuit can perform the resetting in time after completion of the operating state so as to wait the next operating state, thus avoiding the malfunction. Of course, the shift register can be used in various liquid crystal panels including but not limited to the liquid crystal panel with the amorphous silicon thin film transistors.

With reference to FIG. 1, a shift register in an embodiment of the present invention includes a protection circuit 101, a retaining circuit 102, a first driving circuit 103, a second driving circuit 104, an output circuit 105, a resetting circuit 106, a timing control terminal 107, a first power supply terminal 108, a second power supply terminal 109, a third power supply terminal 110 and a fourth power supply terminal 111. The shift register in the embodiment of the present invention can be applied to the GOA panel.

A first input terminal of the protection circuit 101 is connected to the second power supply terminal 109 and a second input terminal of the retaining circuit, a second input terminal of the protection circuit 101 is connected to the first power supply terminal 108, a first output terminal of the protection circuit 101 is connected to a control terminal of the output circuit 105, and a second output terminal of the protection circuit 101 is connected to an output terminal of the output circuit 105, for ensuring the output signal of the output circuit 105 to be at a first level signal.

Figure 2:
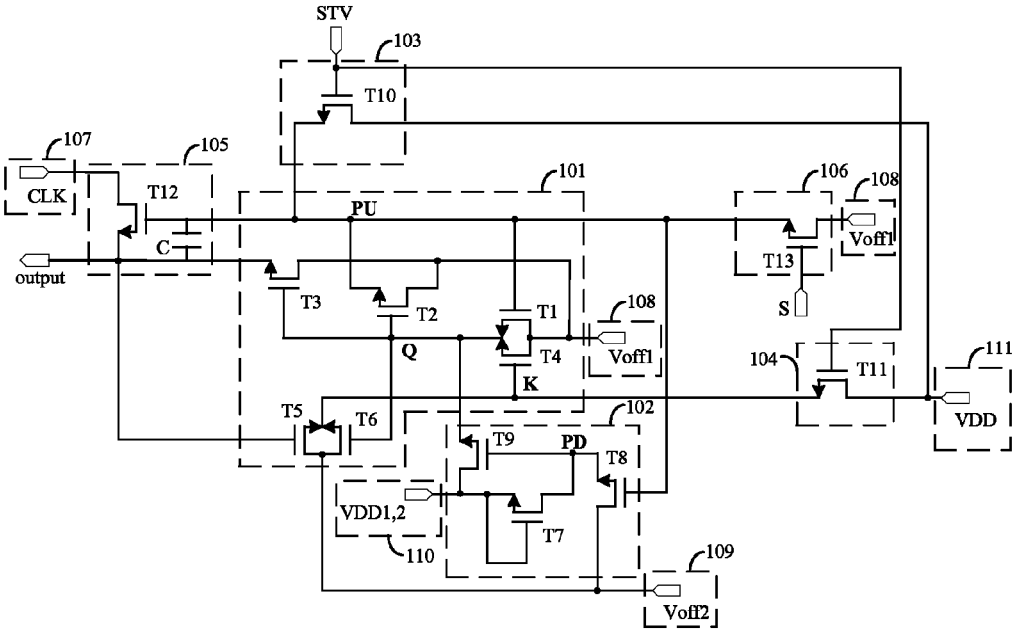
FIG. 2 is a detailed circuit diagram of the shift register in an embodiment of the present invention.

With reference to FIG. 2, the protection circuit 101 in an embodiment of the present invention may include a first transistor (hereinafter referred to as T1 for short), a second transistor (hereinafter referred to as T2 for short), a third transistor (hereinafter referred to as T3 for short), a fourth transistor (hereinafter referred to as T4 for short), a fifth transistor (hereinafter referred to as T5 for short), and a sixth transistor (hereinafter referred to as T6 for short). Preferably, all of the transistors in the embodiment of the present invention may be TFTs. Alternatively, instead of TFTs, triodes can be used; nevertheless, a Field Effect Transistor is a voltage-controlled device, while the triode is a current-controlled device, thus the performance of the circuit adopting the FETs is better than that adopting the triodes.

A gate terminal of T1 serves as a first control terminal of the protection circuit 101, and is connected to a first output terminal of the protection circuit 101; a drain of the T1 is connected to a drain of the T4, and further connected to a node where a drain of the T2, a drain of the T3 and an output terminal of the output circuit 105 (marked as 'output' in FIG. 2) are connected, wherein the node serves as a second input terminal of the protection circuit 101 and is connected to a first power supply terminal 108 (marked as 'Voff1' in FIG. 2);

a source of the T1 is connected to a source of the T4, and further connected to a node where a gate of the T3, a gate of the T2, a gate of the T6 and an output terminal of the retaining circuit 102 are connected, wherein the node is marked as 'Q' in FIG. 2. A source terminal of the T2 serves as a first output terminal of the protection circuit 101, and is connected to a node where the gate of the T1, a control terminal of the output circuit 105, an output terminal of the first driving circuit 104, an output terminal of the resetting circuit 106, and a control terminal of retaining circuit 102 are connected, wherein the node is marked as 'PU' in FIG. 2. A source terminal of the T3 serves as a second output terminal of the protection circuit 101, and is connected to an output terminal of the output circuit 105 and a gate of the T5; a gate of the T4 is connected a node wherein a source of the T5, a source of the T6, and an output terminal of the second protection circuit 104 are connected, wherein the node is marked as 'K' in FIG. 2. A gate terminal of the T5 serves as a second control terminal of the protection circuit 101, and a drain of the T5 is connected to a node to which a drain of the T6 is connected, wherein the node is referred to as a first input terminal of the protection circuit 101 and is further connected to a second input terminal of the retaining circuit 102 and a second power supply terminal 109 (marked as 'Voff2' in FIG. 2); wherein the T1 and T4 mainly act to control the T2 and T3, and the T5 and T6 mainly act to control the T4.

A first input terminal of the retaining circuit 102 is connected to the third power supply terminal 110 (marked as 'VDD1,2' in FIG. 2), a second input terminal of the retaining circuit 102 is connected to the second power supply terminal 109, and an output terminal of the retaining circuit 102 is connected to the protection circuit 101 for controlling the protection circuit 101.

With reference to FIG. 2, the retaining circuit 102 in the embodiment of the present invention can include a seventh transistor (hereinafter referred to as T7 for short), an eighth transistor (hereinafter referred to as T8 for short), and a ninth transistor (hereinafter referred to as T9 for short).

A gate and a source of the T7 are connected together, and further connected to a drain of the T9 and a third power supply terminal 110; a drain of the T7 is connected to a node where a source of the T8 and a gate of the T9 are connected, wherein the node is marked as 'PD' in FIG. 2. A gate terminal of the T8 serves as a control terminal of the retaining circuit 102, and is connected to the source of the T2, the gate of the T1, the control terminal of the output circuit 105, the output terminal of the first driving circuit 104, and the output terminal of the resetting circuit 106; a drain terminal of the T8 serves as a second input terminal of the retaining circuit 102, and is connected to the second power supply terminal 109, the drain of the T5 and the drain of the T6. A source terminal of the T9 serves as an output terminal of the retaining circuit 102, and is connected to the source of the T1, the source of the T4, the gate of the T6, the gate of the T2, and the gate of the T3.

The control terminal of the first driving circuit 103 is connected to a first external signal terminal, and the input terminal of which is connected to the fourth power supply terminal 111, for driving the output circuit 105. A tapping terminal of the first driving circuit 103 in FIG. 1 is connected to the first external signal terminal STV.

With reference to FIG. 2, the driving circuit 103 in the embodiment of the present invention can include a tenth transistor (hereinafter referred to as T10 for short). A gate terminal of the T10 is referred to as the control terminal of the first driving circuit 103, and can be connected to the first external signal terminal. In an embodiment of the present invention, a GOA panel may include a plurality of the shift registers, for example, if the shift register serves as the $n^{th}$ shift register in the GOA panel, then the first external signal terminal may be the output terminal of the $(n-2)^{th}$ shift register, i.e., the output terminal of the output circuit 105 in the $(n-2)^{th}$ shift register. A drain terminal of the T10 serves as an input terminal of the first driving circuit 103, and can be connected to a fourth power supply terminal 111 (marked as 'VDD' in FIG. 2); a source terminal of the T10 serves as an output terminal of the first driving circuit 103, and can be connected to the source of the T2, the gate of the T1, the control terminal of the output circuit 105, the output terminal of the resetting circuit 106 and the gate of the T8.

The control terminal of the second driving circuit 104 is connected to the first external signal terminal, the input terminal of the second driving circuit 104 is connected to the fourth power supply terminal 111, and the output terminal of the second driving circuit 104 is connected to the protection circuit 101, for driving the retaining circuit 102. A tap terminal of the second driving circuit 104 in FIG. 1 is connected to the first external signal terminal.

With reference to FIG. 2, the second driving circuit 104 in an embodiment of the present invention can include the eleventh transistor (hereinafter referred to as T11 for short). A gate terminal of the T11 can be referred to as the control terminal of the second driving circuit 104, and can be connected to the first external signal terminal; the drain terminal of the T11 can be referred to as the input terminal of the second driving circuit 104, and can be connected to the fourth power supply terminal 111; the source terminal of the T11 can be referred to as the output terminal of the second driving circuit 104, and can be connected to the gate of the T4, the source of the T5, and the source of the T6.

The control terminal of the output circuit 105 is connected to the output terminal of the first driving circuit 103, the first output terminal of the protection circuit 101, the first control terminal of the protection circuit 101, the output terminal of the resetting circuit 106 and the control terminal of the retaining circuit 102 respectively, and the output terminal of the output circuit 105 is connected to the second output terminal of the protection circuit 101, for outputting a signal.

With reference to FIG. 2, the output circuit 105 in an embodiment of the present invention can include a twelfth transistor (hereinafter referred to as T12 for short) and a first capacitor (hereinafter referred to as C for short). A gate terminal of the T12 can be referred to as the control terminal of the output circuit 105, and can be connected to the source of the T2, the gate of the T1, the gate of the T8 and the output terminal of the resetting circuit 106. A drain terminal of the T12 can be referred to as the input terminal of the output circuit 105, and can be connected to a timing control terminal 107; a source terminal of the T12 can be referred to as the output terminal of the output circuit 105, and can be connected to the source of the T3 and the gate of the T5. The source of the T12 can be connected to gates of each TFT in the GOA panel, for supplying a gate scanning signal to the GOA panel; and can also serve as a first external signal terminal for other shift registers. In FIG. 2, the C is drawn separately to show that the C is connected between the gate and the source of the T12. In practical applications, the C can be integrated into the T12 directly in the manufacturing process, that is, the C and T12 are integrated together, and the C also contains the capacitance of the T12 itself. Therefore, only the C is drawn in FIG. 2, and no detailed explanations for the C are given in the description. The output terminal of the output circuit 105 in FIG. 2, i.e., the output terminal of the shift register is marked as 'output'.

An input terminal of the resetting circuit 106 is connected to the first power supply terminal 108, and a control terminal thereof is connected to the second external signal terminal, for resetting the shift register. A tapping terminal of the resetting circuit 106 in FIG. 1 is connected to the second external signal terminal.

With reference to FIG. 2, the resetting circuit 106 in an embodiment of the present invention can include the thirteenth transistor (hereinafter referred to as T13 for short). A gate terminal of the T13 can be referred to as the control terminal of the resetting circuit 106, and can be connected to the second external signal terminal. In an embodiment of the present invention, for example, when the shift register serves as the $n^{th}$ shift register in the GOA panel, the second external signal terminal may be the output terminal of the $(n+2)^{th}$ shift register, i.e., the output terminal of the output circuit 105 in the $(n+2)^{th}$ shift register. A drain terminal of the T13 can be referred to as an input terminal of the resetting circuit 106, and can be connected to the first power supply terminal 108; a source terminal of the T13 serves as an output terminal of the resetting circuit 106, and can be connected to the gate of the T8, the gate of the T1, the source of the T2 and the gate of the T12. The second external signal terminal is marked as 'S' in FIG. 2.

Figure 3:
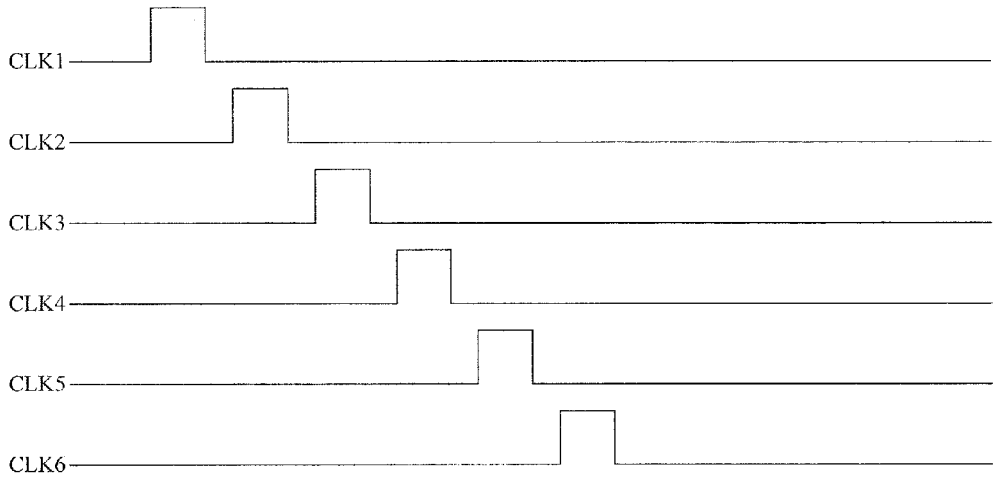
FIG. 3 is a timing chart of the timing control signals in an embodiment of the present invention.
Figure 4:
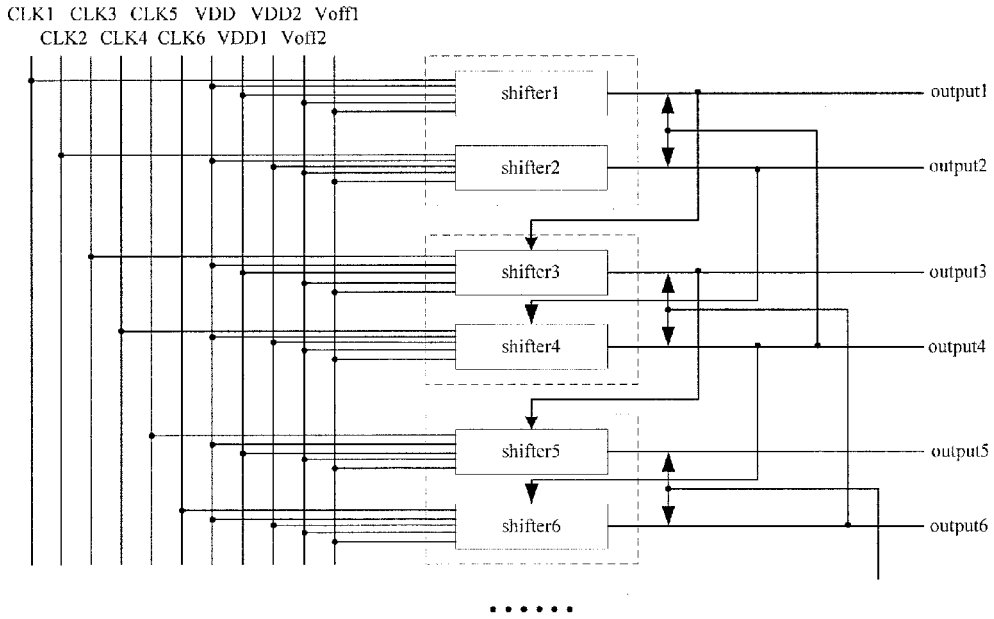
FIG. 4 is a schematic diagram of a GOA TFT-LCD panel in an embodiment of the present invention.

The timing control terminal 107 is used to supply a first number of timing control signals to the GOA panel. The timing control terminal 107 is marked as 'CLK' in FIG. 2. The timing control terminal 107 can be connected to a corresponding timing control circuit, and supplies a timing control signal to the shift register by odd or even row. In an embodiment of the present invention, the first number can be 6, that is, the timing control terminal 107 can provide the GOA panel with six timing control signals CLK1-CLK6, and the six timing control signals are illustrated in FIG. 3. Each timing control signal is connected to one of the shift registers, and may be at a second level signal in a time-division mode. In an embodiment of the present invention, a first level signal can be a low level signal, and a second level signal can be a high level signal. For example, FIG. 4 shows a GOA panel in an embodiment of the present invention. In FIG. 4, each 'shifter' in FIG. 4 represents one of the shift registers, and every two shift registers are arranged in one block with dotted lines as a whole unit, wherein one shift register locates in an odd line, and the other shift register locates in an even line, 'output1'-'output6' represent the output terminals of the six shift registers shown. In an embodiment of the present invention, there is a plurality of shift registers in one GOA panel, and a 'shifter' in FIG. 4 is a shift register. Assuming that one of the shift registers 'shifter1' is the $n^{th}$ shift register, then the timing control terminal 107 may supply a timing control signal CLK1 to the $n^{th}$ shift register, supply a timing control signal CLK2 to the $(n+1)^{th}$ shift register, i.e., 'shifter2', . . . , and similarly supply a timing control signal CLK6 to the $(n+5)^{th}$ shift register, i.e., 'shifter6', and in turn supply the timing control signal CLK1 to the $(n+6)^{th}$ shift register, and so on, in such a cycle. All the shift registers in one GOA panel operate in sequence, that is, after the $n^{th}$ shift register completes its operation, the $(n+1)^{th}$ shift register begins to operate. Since there are many timing control signals, a time period, from the completion of the operation of the $n^{th}$ shift register to that the completion of the $(n+1)^{th}$ shift register, may be used for the $n^{th}$ shift register to complete its resetting operation, so that the shift register can be reset completely, thus avoiding the interference due to the existing of the residual signal. Additionally, it can reduce the power consumption by increasing the number of the timing control signals.

A first power supply terminal 108 is used to supply a power signal to the protection circuit 101. In an embodiment of the present invention, the first power supply terminal 108 can provide the protection circuit 101 with the first level signal.

A second power supply terminal 109 is used to supply a power signal to the retaining circuit 102 and the protection circuit 101. In an embodiment of the present invention, the second power supply terminal 109 can provide the retaining circuit 102 and the protection circuit 101 with the first level signal. Although both the first power supply terminal 108 and the second power supply terminal 109 provide the circuit with the first level signal, it is necessary for the first power supply terminal 108 to ensure the output signal of the output circuit 105 to be the first level signal in the case of the shift register being in a non-operating state, while the second power supply terminal 109 only provides an input signal for the corresponding transistors, and thus the power of a first power supply to which the first power supply terminal 108 is connected may be larger than that of a second power supply to which the second power supply terminal 109 is connected.

A third power supply terminal 110 is used to supply a power signal to the retaining circuit 102. In an embodiment of the present invention, the third power supply terminal 110 can provide the retaining circuit 102 with the second level signal. The third power supply terminal 110 is marked as 'VDD1,2' in FIG. 2, representing that two adjacent shift registers may be connected to different third power supply terminals 110. In an embodiment of the present invention, two third power supply terminals 110 can be provided, i.e., VDD1 and VDD2, respectively, the properties of the power suppliers, such as the power and the like, to which the two third power supply terminals 110 are connected may be identical. The reason why two adjacent shift registers are connected to different power supply terminals is to avoid the potential interference generated by each other.

A fourth power supply terminal 111 is used to supply a power signal to the first driving circuit 103 and the second driving circuit 104. In an embodiment of the present invention, the fourth power supply terminal 111 may provide the first driving circuit 103 and the fourth driving circuit 104 with the second level signal.

In an embodiment of the present invention, the procedure of the gate driving method can be divided into four steps, i.e., four states, and will be illustrated hereinafter:

A first state is an idle state, and the idle state is the state in which the next operation has not started after the completion of the last resetting.

Taking the $n^{th}$ shift register as an example, it is assumed that the timing control terminal 107 provides the $n^{th}$ shift register with the timing control signal CLK1.

At this time, the $(n-2)^{th}$ shift register has not operated, and the first external signal terminal (marked as 'STV' in FIG. 2, a row start signal) supplies the first level signal to the T10 and the T11, and thus the T10 and T11 turn off; the node PU in FIG. 2 is at the first level signal, and thus the T12. T1 and T8 all turn off. At this time, the $(n+2)^{th}$ shift register has not operated, and then the second external signal terminal supplies the first level signal to the gate of the T13, and thus the T13 turns off. The third power supply terminal 110 supplies the second level signal to the retaining circuit 102, and the T7 turns on; the node PD is at the second level signal, and the T9 turns on; the node Q is at the second level signal, and the T6, T2 and T3 turn on. The power supply terminal 109 supplies the first level signal to the protection circuit 101, the node K is at the first level signal, and thus the T4 turns off. The first power supply terminal 108 supplies the first level signal to the protection circuit 101 to ensure the output signal to be at the first level signal, and the T5 turns off.

A second state is a charging state, and the charging state can be a state in which the shift register waits to operate.

When the $(n-2)^{th}$ shift register begins to operate, the $n^{th}$ shift register begins a procedure for being charged. The first external signal terminal outputs the second level signal to the gates of the T10 and T11 in the $n^{th}$ shift register so as to turn on the T10 and T11. Meantime, the node PU is at the second level signal, and the T12, T1 and T8 all turn on. At this time, the $(n-2)^{th}$ shift register is in operation, the $(n+2)^{th}$ shift register has not begun to operate, and thus the second external signal terminal supplies the first level signal to the gate of the T13, and the T13 turns off. The third power supply terminal 110 supplies the second level signal to the retaining circuit 102, and the T7 turns on; since both the T7 and T8 turn on, the node PD would be at the first level signal as the T8 turns on, while the same node PD would be at the second level signal as the T7 turns on; in general, since the T8 is relatively larger and the T7 is relatively smaller, the level signal at the node PD may be determined by the T8, that is, the node PD is at the first level signal, and thus the T9 turn off. As the first power supply terminal 108 supplies the first level signal to the protection circuit 101, the T1 turns on; then the node Q is at the first level signal, and the T6, T2 and T3 turn off. Since the T11 turns on, the node K is at the second level signal, and the T4 turns on. Meanwhile, it can ensure the output signal of the T12 to be at the first level signal, and the T5 turns off.

A third state is an output state, i.e., operating state.

At this time, the current shift register begins to operate, and the $(n-2)^{th}$ shift register stop operating, and the first external signal terminal supplies the first level signal to the gates of the T10 and T11 in the $n^{th}$ shift register so as to turn off the T10 and T11. Meantime, the node PU is at the second level signal, and the T12, T1 and T8 all turn on. At this time, the $n^{th}$ shift register is in operation, the $(n+2)^{th}$ shift register has not begun to operate, and thus the second external signal terminal supplies the first level signal to the gate of the T13, and the T13 turns off. The third power supply terminal 110 supplies the second level signal to the retaining circuit 102, and the T7 turns on; since both the T7 and T8 turn on, the node PD would be at the first level signal as the T8 turns on, while the same node PD would be at the second level signal as the T7 turns on; in general, since the T8 is relatively larger and the T7 is relatively smaller, the level signal at the node PD can be determined by the T8, that is, the node PD is at the first level signal, and thus the T9 turn off. As the first power supply terminal 108 supplies the first level signal to the protection circuit 101, the T1 turns on; then the node Q is at the first level signal, and the T6, T2 and T3 turn off. Since the T11 turns off, the node K is at the first level signal, and the T4 turns off. Meanwhile, it can ensure the output signal of the T12 to be at the second level signal, and the T5 turns on. In operating state, turning off the T2 and T3 may prevent the T2 and T3 from potentially generating a leaking current, which might result in an interference to the normal output signal and also increase the output load.

A fourth state is a resetting state. After the operation completes, the shift register may enter into the resetting state.

At this time, the current shift register stops operating and the $(n-2)^{th}$ shifting also stops operating, and the first external signal terminal supplies the first level signal to the gate of the T10 and the gate of the T11 in the $n^{th}$ shift register so as to turn off the T10 and T11. Meanwhile, the node PU is at the first level signal, and thus the T12, T1 and T8 all turn off. At this time, the $(n+2)^{th}$ shift register is in operation, and then the second external signal terminal supplies the second level signal to the gate of the T13, and thus the T13 turns on. The third power supply terminal 110 supplies the second level signal to the retaining circuit 102, and the T7 turns on; the node PD is at the second level signal, and the T9 turns on; the node Q is at the second level signal, and the T6, T2 and T3 turn on. As the T11 turns off, the node K is at the first level signal, and thus the T4 turns off. Meanwhile, it can ensure the output signal of the shift register to be at the first level signal, and the T5 turns off.

As shown in FIG. 4, an embodiment of the present invention further provides a GOA panel comprising at least one of the shift registers described above.

Hereinafter a method for gate driving according to an embodiment of the present invention will be introduced by means of a specific embodiment.

Figure 5:
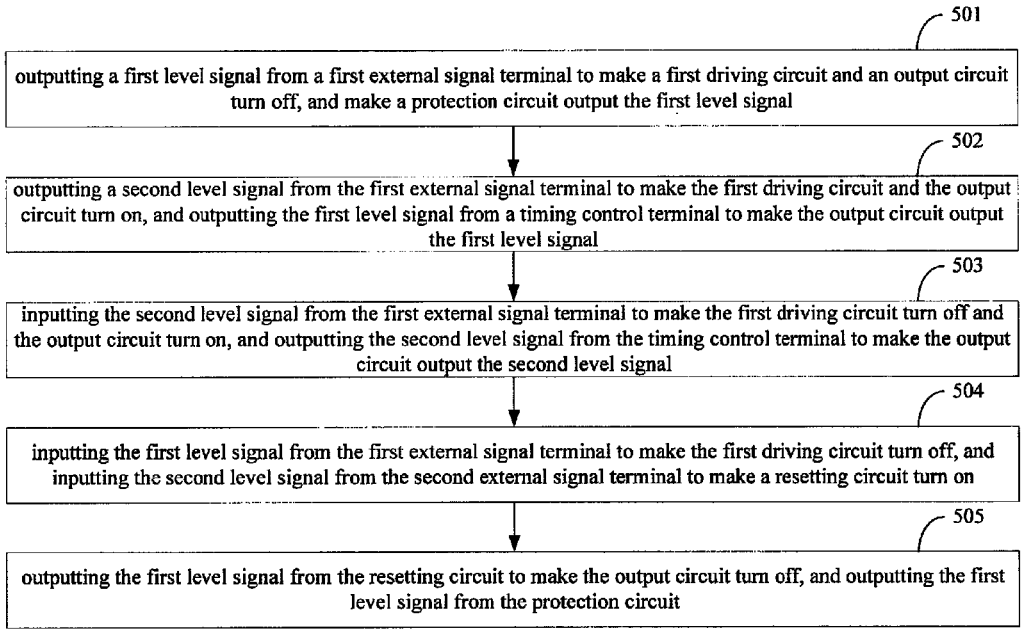
FIG. 5 is a main flowchart of a gate driving method in an embodiment of the present invention.

As shown in FIG. 5, the main flow of the method for gate driving in the embodiment of the present invention is as follows, and the method may be applied to the GOA panel mentioned above.

step 501: the first external signal terminal outputs the first level signal to make the first driving circuit 103 and the output circuit 105 turn off, and make the protection circuit 101 output the first level signal;

step 502: the first external signal terminal outputs the second level signal to make the first driving circuit 103 and the output circuit 105 turn on, and the timing control terminal 107 outputs the first level signal to make the output circuit 105 output the first level signal;

step 503: the first external signal terminal inputs the second level signal to make the first driving circuit 103 turn off and the output circuit 105 turn on, and the timing control terminal 107 outputs the second level signal to make the output circuit 105 output the second level signal;

step 504: the first external signal terminal inputs the first level signal to make the first driving circuit 103 turn off, and the second external signal terminal inputs the second level signal to make the resetting circuit 106 turn on; and step 505: the resetting circuit 106 outputs the first level signal to make the output circuit 105 turn off, and make the protection circuit 101 output the first level signal.

Wherein the step 501 represents the idle state, the step 502 represents the charging state, the step 503 represents the outputting state, and the steps 504 and 505 represent the resetting state.

The shift register in the embodiment of the present invention includes: the protection circuit for ensuring the output signal of the output circuit to be at a first level signal, the retaining circuit for controlling the protection circuit, the output circuit for outputting a signal, the first driving circuit for driving the output circuit, the second driving circuit for driving the retaining circuit, the resetting circuit for resetting the shift register, the timing control terminal for providing the GOA panel with a first number of timing control signals, the first power supply terminal for supplying a power signal to the protection circuit, the second power supply terminal for supplying a power signal to the retaining circuit and the protection circuit, the third power supply terminal for supplying a power signal to the retaining circuit, and the fourth power supply terminal for supplying a power signal to the first driving circuit and the second driving circuit; wherein the timing control terminal is connected to the input terminal of the output circuit; the control terminal of the first driving circuit is connected to the first external signal terminal, and the input terminal of the first driving circuit is connected to the fourth power supply terminal; the control terminal of the second driving circuit is connected to the first external signal terminal, and the input terminal of the second driving circuit is connected to the fourth power supply terminal, and the output terminal of which is connected to the protection circuit; the first input terminal of the retaining circuit is connected to the third power supply terminal, and the second input terminal of the retaining circuit is connected to the second power supply terminal, and the output terminal of which is connected to the protection circuit; the first input terminal of the protection circuit is connected to the second power supply terminal and the second input terminal of the retaining circuit, and the second input terminal of the protection circuit is connected to the first power supply terminal; the control terminal of the output circuit is connected to the output terminal of the first driving circuit, the first output terminal of the protection circuit, the first control terminal of the protection circuit, the output terminal of the resetting circuit and the control terminal of the retaining circuit, respectively, and the output terminal of the output circuit is connected to the second control terminal of the protection circuit; the input terminal of the resetting circuit is connected to the first power supply terminal, and the control terminal of which is connected to the second external signal terminal. It can avoid the potential interference and perform the effective driving with the protection circuit and the retaining circuit controlling the output circuit to output appropriate signals; in the meantime, since multiple timing control signals are employed in the GOA panel, it can effectively reduce the power consumption. Additionally, the resetting circuit may perform the resetting in time after the completion of the operating state so as to wait the next operating state, thus avoiding the malfunction. By adding the protection circuit, the first level signal is output in a non-operating state to ensure the output signal of the shift register to be at the first level signal, and no signal is output in an operating state to avoid generating interference to the normal output signal.

Apparently, those skilled in the art can make various modifications and variations on the present invention without departing from the spirit and scope of the present invention. Thus, if these modifications and variations belong to the scopes of the claims of the invention and the equivalents thereof, and the present invention intends to cover such modifications and variations.

What is claimed is:

1. A shift register applied to a Gate driver On Array TFT-LCD panel, including a protection circuit for ensuring an output signal of an output circuit to be at a first level signal, a retaining circuit for controlling the protection circuit, an output circuit for outputting a signal, a first driving circuit for driving the output circuit, a second driving circuit for driving the retaining circuit, a resetting circuit for resetting the shift register, a timing control terminal for supplying a first number of timing control signals to the GOA TFT-LCD panel, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit;

wherein the timing control terminal is connected to an input terminal of the output circuit;

a control terminal of the first driving circuit is connected to a first external signal terminal, and an input terminal of which is connected to the fourth power supply terminal;

a control terminal of the second driving circuit is connected to the first external signal terminal, an input terminal of which is connected to the fourth power supply terminal, and an output terminal of which is connected to the protection circuit;

a first input terminal of the retaining circuit is connected to the third power supply terminal, a second input terminal of which is connected to the second power supply terminal, and an output terminal of which is connected to the protection circuit;

a first input terminal of the protection circuit is connected to the second power supply terminal and the second input terminal of the retaining circuit, and a second input terminal of the protection circuit is connected to the first power supply terminal;

a control terminal of the output circuit is connected to an output terminal of the first driving circuit, a first output terminal of the protection circuit, a first control terminal of the protection circuit, an output terminal of the resetting circuit and a control terminal of the retaining circuit, respectively, and an output terminal of the output circuit is connected to a second control terminal of the protection circuit; and an input terminal of the resetting circuit is connected to the first power supply terminal, and a control terminal of which is connected to a second external signal terminal.

2. The shift register as recited in claim 1, wherein the first driving circuit comprises a tenth transistor, and the protection circuit comprises a first transistor and a second transistor, the retaining circuit comprises an eighth transistor, the output circuit comprises a twelfth transistor, and the resetting circuit comprises a thirteenth transistor;

a gate terminal of the tenth transistor serves as the control terminal of the first driving circuit, and is connected to the first external signal terminal;

a drain terminal of the tenth transistor serves as the input terminal of the first driving circuit, and is connected to the fourth power supply terminal; and a source terminal of the tenth transistor serves as the output terminal of the first driving circuit, and is connected to a gate of the eighth transistor, a gate of the first transistor, a source of the second transistor, a source of the thirteenth transistor and a gate of the twelfth transistor.

3. The shift register as recited in claim 1, wherein the second driving circuit comprises an eleventh transistor, and the protection circuit comprises a fourth transistor, a fifth transistor and a sixth transistor;

a gate terminal of the eleventh transistor serves as the control terminal of the second driving circuit, and is connected to the first external signal terminal;

a drain terminal of the eleventh transistor serves as the input terminal of the second driving circuit, and is connected to the fourth power supply terminal; and a source terminal of the eleventh transistor serves as the output terminal of the second driving circuit, and is connected to a gate of the fourth transistor, a source of the fifth transistor and a source of the sixth transistor.

4. The shift register as recited in claim 1, wherein the retaining circuit comprises a seventh transistor, an eighth transistor, and a ninth transistor, the protection circuit comprises a first transistor, a second transistor, a third transistor, a fourth transistor, a fifth transistor and a sixth transistor, the resetting circuit comprises a thirteenth transistor, the first driving circuit comprises a tenth transistor, and the output circuit comprises a twelfth transistor;

a source of the seventh transistor is connected to a gate of the seventh transistor, and a node to which the gate and the source of which are connected serves as the first input terminal of the retaining circuit and is further connected to a drain of the ninth transistor;

a drain of the seventh transistor is connected to a source of the eighth transistor and a gate of the ninth transistor;

a drain of the eighth transistor is connected to the second power supply terminal, a drain of the fifth transistor and a drain of the sixth transistor;

a gate terminal of the eighth transistor serves as the control terminal of the retaining circuit, and is connected to a source of the thirteenth transistor, a gate of the first transistor, a source of the second transistor, a source of the tenth transistor and a gate of the twelfth transistor; and a source of the ninth transistor is connected to a source of the first transistor, a source of the fourth transistor, a gate of the second transistor, a gate of the third transistor and a gate of the sixth transistor.

5. The shift register as recited in claim 1, wherein the protection circuit comprises a first transistor, a second transistor, a third transistor, a fourth transistor, a fifth transistor and a sixth transistor; the first driving circuit comprises a tenth transistor; the second driving circuit comprises an eleventh transistor; the resetting circuit comprises a thirteenth transistor; the output circuit comprises a twelfth transistor; and the retaining circuit comprises an eighth transistor and a ninth transistor;

a gate terminal of the first transistor serves as the first output terminal of the protection circuit, and is connected to a source of the second transistor, a gate of the eighth transistor, a source of the tenth transistor, a gate of the twelfth transistor and a source of the thirteenth transistor;

a source of the first transistor is connected to a source of the fourth transistor, a gate of the second transistor, a gate of the third transistor, a gate of the sixth transistor and a source of the ninth transistor;

a drain terminal of the first transistor serves as the second input terminal of the protection circuit, and is connected to the first power supply terminal, a drain of the second transistor, a drain of the third transistor;

a gate of the fourth transistor is connected to a source of the fifth transistor, a source of the sixth transistor and a source of the eleventh transistor;

a gate terminal of the fifth transistor serves as the second output terminal of the protection circuit, and is connected to a source of the third transistor and a source of the twelfth transistor; and a drain terminal of the fifth transistor serves as the first input terminal of the protection circuit, and is connected to a drain of the sixth transistor, a drain of the eighth transistor and the second power supply terminal.

6. The shift register as recited in claim 1, wherein the output circuit comprises a twelfth transistor; the first driving circuit comprises a tenth transistor; the second driving circuit comprises an eleventh transistor; the protection circuit comprises a first transistor, a second transistor, a third transistor and a fifth transistor; the retaining circuit comprises an eighth transistor; and the resetting circuit comprises a thirteenth transistor;

a gate terminal of the twelfth transistor serves as the control terminal of the output circuit, and is connected to a gate of the first transistor, a source of the second transistor, a gate of the eighth transistor, a source of the tenth transistor and a source of the thirteenth transistor;

a drain terminal of the twelfth transistor serves as the input terminal of the output circuit, and is connected to the timing control terminal; and a source terminal of the twelfth transistor serves as the output terminal of the output circuit, and is connected to a source of the third transistor and a gate of the fifth transistor.

7. The shift register as recited in claim 1, wherein the resetting circuit comprises a thirteen transistor; the protection circuit comprises a first transistor and a second transistor; the retaining circuit comprises an eighth transistor; the first driving circuit comprises a tenth transistor; and the output circuit comprises a twelfth transistor;

a gate terminal of the thirteenth transistor serves as the control terminal of the resetting circuit, and is connected to the second external signal terminal;

a drain terminal of the thirteenth transistor serves as the input terminal of the resetting circuit, and is connected to the first power supply terminal; and a source terminal of the thirteenth transistor serves as the output terminal of the resetting circuit, and is connected to a gate of the first transistor, a source of the second transistor, a gate of the eighth transistor, a source of the tenth transistor and a gate of the twelfth transistor.

8. The shift register as recited in claim 1, wherein the timing control terminal supplies six timing control signals to the shift register, and the six timing control signals are at a second level signal in a time-division mode.

9. A Gate driver On Array (GOA) TFT-LCD panel comprising at least one of shift registers applied to the Gate driver On Array TFT-LCD panel, wherein each of the at least one of shift registers comprises a protection circuit for ensuring an output signal of an output circuit to be at a first level signal, a retaining circuit for controlling the protection circuit, an output circuit for outputting a signal, a first driving circuit for driving the output circuit, a second driving circuit for driving the retaining circuit, a resetting circuit for resetting the shift register, a timing control terminal for supplying a first number of timing control signals to the GOA TFT-LCD panel, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit;

wherein the timing control terminal is connected to an input terminal of the output circuit;

a control terminal of the first driving circuit is connected to a first external signal terminal, and an input terminal of which is connected to the fourth power supply terminal;

a control terminal of the second driving circuit is connected to the first external signal terminal, an input terminal of which is connected to the fourth power supply terminal, and an output terminal of which is connected to the protection circuit;

a first input terminal of the retaining circuit is connected to the third power supply terminal, a second input terminal of which is connected to the second power supply terminal, and an output terminal of which is connected to the protection circuit;

a first input terminal of the protection circuit is connected to the second power supply terminal and the second input terminal of the retaining circuit, and a second input terminal of the protection circuit is connected to the first power supply terminal;

a control terminal of the output circuit is connected to an output terminal of the first driving circuit, a first output terminal of the protection circuit, a first control terminal of the protection circuit, an output terminal of the resetting circuit and a control terminal of the retaining circuit, respectively, and an output terminal of the output circuit is connected to a second control terminal of the protection circuit; and an input terminal of the resetting circuit is connected to the first power supply terminal, and a control terminal of which is connected to a second external signal terminal.

10. The GOA TFT-LCD panel as recited in claim 9, wherein the first driving circuit comprises a tenth transistor, and the protection circuit comprises a first transistor and a second transistor, the retaining circuit comprises an eighth transistor, the output circuit comprises a twelfth transistor, and the resetting circuit comprises a thirteenth transistor;

a gate terminal of the tenth transistor serves as the control terminal of the first driving circuit, and is connected to the first external signal terminal;

a drain terminal of the tenth transistor serves as the input terminal of the first driving circuit, and is connected to the fourth power supply terminal; and a source terminal of the tenth transistor serves as the output terminal of the first driving circuit, and is connected to a gate of the eighth transistor, a gate of the first transistor, a source of the second transistor, a source of the thirteenth transistor and a gate of the twelfth transistor.

11. The GOA TFT-LCD panel as recited in claim 9, wherein the second driving circuit comprises an eleventh transistor, and the protection circuit comprises a fourth transistor, a fifth transistor and a sixth transistor;

a gate terminal of the eleventh transistor serves as the control terminal of the second driving circuit, and is connected to the first external signal terminal;

a drain terminal of the eleventh transistor serves as the input terminal of the second driving circuit, and is connected to the fourth power supply terminal; and a source terminal of the eleventh transistor serves as the output terminal of the second driving circuit, and is connected to a gate of the fourth transistor, a source of the fifth transistor and a source of the sixth transistor.

12. The GOA TFT-LCD panel as recited in claim 9, wherein the retaining circuit comprises a seventh transistor, an eighth transistor, and a ninth transistor, the protection circuit comprises a first transistor, a second transistor, a third transistor, a fourth transistor, a fifth transistor and a sixth transistor, the resetting circuit comprises a thirteenth transistor, the first driving circuit comprises a tenth transistor, and the output circuit comprises a twelfth transistor;

a source of the seventh transistor is connected to a gate of the seventh transistor, and a node to which the gate and the source of which are connected serves as the first input terminal of the retaining circuit and is further connected to a drain of the ninth transistor;

a drain of the seventh transistor is connected to a source of the eighth transistor and a gate of the ninth transistor;

a drain of the eighth transistor is connected to the second power supply terminal, a drain of the fifth transistor and a drain of the sixth transistor;

a gate terminal of the eighth transistor serves as the control terminal of the retaining circuit, and is connected to a source of the thirteenth transistor, a gate of the first transistor, a source of the second transistor, a source of the tenth transistor and a gate of the twelfth transistor; and a source of the ninth transistor is connected to a source of the first transistor, a source of the fourth transistor, a gate of the second transistor, a gate of the third transistor and a gate of the sixth transistor.

13. The GOA TFT-LCD panel as recited in claim 9, wherein the protection circuit comprises a first transistor, a second transistor, a third transistor, a fourth transistor, a fifth transistor and a sixth transistor; the first driving circuit comprises a tenth transistor; the second driving circuit comprises an eleventh transistor; the resetting circuit comprises a thirteenth transistor; the output circuit comprises a twelfth transistor; and the retaining circuit comprises an eighth transistor and a ninth transistor;

a gate terminal of the first transistor serves as the first output terminal of the protection circuit, and is connected to a source of the second transistor, a gate of the eighth transistor, a source of the tenth transistor, a gate of the twelfth transistor and a source of the thirteenth transistor;

a source of the first transistor is connected to a source of the fourth transistor, a gate of the second transistor, a gate of the third transistor, a gate of the sixth transistor and a source of the ninth transistor;

a drain terminal of the first transistor serves as the second input terminal of the protection circuit, and is connected to the first power supply terminal, a drain of the second transistor, a drain of the third transistor;

a gate of the fourth transistor is connected to a source of the fifth transistor, a source of the sixth transistor and a source of the eleventh transistor;

a gate terminal of the fifth transistor serves as the second output terminal of the protection circuit, and is connected to a source of the third transistor and a source of the twelfth transistor; and a drain terminal of the fifth transistor serves as the first input terminal of the protection circuit, and is connected to a drain of the sixth transistor, a drain of the eighth transistor and the second power supply terminal.

14. The GOA TFT-LCD panel as recited in claim 9, wherein the timing control terminal supplies six timing control signals to the shift register, and the six timing control signals are at a second level signal in a time-division mode.

15. A gate driving method applied to a Gate driver On Array (GOA) TFT-LCD panel, comprises the steps of:

outputting a first level signal from a first external signal terminal to make a first driving circuit and an output circuit turn off, and make a protection circuit output the first level signal;

outputting a second level signal from the first external signal terminal to make the first driving circuit and the output circuit turn on, and outputting the first level signal from a timing control terminal to make the output circuit output the first level signal;

inputting the second level signal from the first external signal terminal to make the first driving circuit turn off and the output circuit turn on, and outputting the second level signal from the timing control terminal to make the output circuit output the second level signal;

inputting the first level signal from the first external signal terminal to make the first driving circuit turn off, and inputting the second level signal from the second external signal terminal to make a resetting circuit turn on; and outputting the first level signal from the resetting circuit to make the output circuit turn off, and outputting the first level signal from the protection circuit;

wherein the GOA TFT-LCD panel is applied to the Gate driver On Array TFT-LCD panel and comprises at least one of shift registers, and each of the at least one of shift registers comprises the protection circuit for ensuring an output signal of an output circuit to be at a first level signal, a retaining circuit for controlling the protection circuit, the output circuit for outputting a signal, the first driving circuit for driving the output circuit, a second driving circuit for driving the retaining circuit, the resetting circuit for resetting the shift register, the timing control terminal for supplying a first number of timing control signals to the GOA TFT-LCD panel, a first power supply terminal for supplying a power signal to the protection circuit, a second power supply terminal for supplying a power signal to the retaining circuit and the protection circuit, a third power supply terminal for supplying a power signal to the retaining circuit, and a fourth power supply terminal for supplying a power signal to the first driving circuit and the second driving circuit;

wherein the timing control terminal is connected to an input terminal of the output circuit;

a control terminal of the first driving circuit is connected to a first external signal terminal, and an input terminal of which is connected to the fourth power supply terminal;

a control terminal of the second driving circuit is connected to the first external signal terminal, an input terminal of which is connected to the fourth power supply terminal, and an output terminal of which is connected to the protection circuit;

a first input terminal of the retaining circuit is connected to the third power supply terminal, a second input terminal of which is connected to the second power supply terminal, and an output terminal of which is connected to the protection circuit;

a first input terminal of the protection circuit is connected to the second power supply terminal and the second input terminal of the retaining circuit, and a second input terminal of the protection circuit is connected to the first power supply terminal;

a control terminal of the output circuit is connected to an output terminal of the first driving circuit, a first output terminal of the protection circuit, a first control terminal of the protection circuit, an output terminal of the resetting circuit and a control terminal of the retaining circuit, respectively, and an output terminal of the output circuit is connected to a second control terminal of the protection circuit; and an input terminal of the resetting circuit is connected to the first power supply terminal, and a control terminal of which is connected to a second external signal terminal.

16. The gate driving method as recited in claim 15, wherein the first driving circuit comprises a tenth transistor, and the protection circuit comprises a first transistor and a second transistor, the retaining circuit comprises an eighth transistor, the output circuit comprises a twelfth transistor, and the resetting circuit comprises a thirteenth transistor;

a gate terminal of the tenth transistor serves as the control terminal of the first driving circuit, and is connected to the first external signal terminal;

a drain terminal of the tenth transistor serves as the input terminal of the first driving circuit, and is connected to the fourth power supply terminal; and a source terminal of the tenth transistor serves as the output terminal of the first driving circuit, and is connected to a gate of the eighth transistor, a gate of the first transistor, a source of the second transistor, a source of the thirteenth transistor and a gate of the twelfth transistor.

17. The gate driving method as recited in claim 15, wherein the second driving circuit comprises an eleventh transistor, and the protection circuit comprises a fourth transistor, a fifth transistor and a sixth transistor;

a gate terminal of the eleventh transistor serves as the control terminal of the second driving circuit, and is connected to the first external signal terminal;

a drain terminal of the eleventh transistor serves as the input terminal of the second driving circuit, and is connected to the fourth power supply terminal; and a source terminal of the eleventh transistor serves as the output terminal of the second driving circuit, and is connected to a gate of the fourth transistor, a source of the fifth transistor and a source of the sixth transistor.

18. The gate driving method as recited in claim 15, wherein the retaining circuit comprises a seventh transistor, an eighth transistor, and a ninth transistor, the protection circuit comprises a first transistor, a second transistor, a third transistor, a fourth transistor, a fifth transistor and a sixth transistor, the resetting circuit comprises a thirteenth transistor, the first driving circuit comprises a tenth transistor, and the output circuit comprises a twelfth transistor;

a source of the seventh transistor is connected to a gate of the seventh transistor, and a node to which the gate and the source of which are connected serves as the first input terminal of the retaining circuit and is further connected to a drain of the ninth transistor;

a drain of the seventh transistor is connected to a source of the eighth transistor and a gate of the ninth transistor;

a drain of the eighth transistor is connected to the second power supply terminal, a drain of the fifth transistor and a drain of the sixth transistor;

a gate terminal of the eighth transistor serves as the control terminal of the retaining circuit, and is connected to a source of the thirteenth transistor, a gate of the first transistor, a source of the second transistor, a source of the tenth transistor and a gate of the twelfth transistor; and a source of the ninth transistor is connected to a source of the first transistor, a source of the fourth transistor, a gate of the second transistor, a gate of the third transistor and a gate of the sixth transistor.

19. The gate driving method as recited in claim 15, wherein the protection circuit comprises a first transistor, a second transistor, a third transistor, a fourth transistor, a fifth transistor and a sixth transistor; the first driving circuit comprises a tenth transistor; the second driving circuit comprises an eleventh transistor; the resetting circuit comprises a thirteenth transistor; the output circuit comprises a twelfth transistor; and the retaining circuit comprises an eighth transistor and a ninth transistor;

a gate terminal of the first transistor serves as the first output terminal of the protection circuit, and is connected to a source of the second transistor, a gate of the eighth transistor, a source of the tenth transistor, a gate of the twelfth transistor and a source of the thirteenth transistor;

a source of the first transistor is connected to a source of the fourth transistor, a gate of the second transistor, a gate of the third transistor, a gate of the sixth transistor and a source of the ninth transistor;

a drain terminal of the first transistor serves as the second input terminal of the protection circuit, and is connected to the first power supply terminal, a drain of the second transistor, a drain of the third transistor;

a gate of the fourth transistor is connected to a source of the fifth transistor, a source of the sixth transistor and a source of the eleventh transistor;

a gate terminal of the fifth transistor serves as the second output terminal of the protection circuit, and is connected to a source of the third transistor and a source of the twelfth transistor; and a drain terminal of the fifth transistor serves as the first input terminal of the protection circuit, and is connected to a drain of the sixth transistor, a drain of the eighth transistor and the second power supply terminal.

20. The gate driving method as recited in claim 15, wherein the timing control terminal supplies six timing control signals to the shift register, and the six timing control signals are at a second level signal in a time-division mode.

* * * * *